United States Patent [19]

Egami et al.

[11] 4,053,333

[45] Oct. 11, 1977

[54] ENHANCING MAGNETIC PROPERTIES OF AMORPHOUS ALLOYS BY ANNEALING UNDER STRESS

[75] Inventors: Takeshi Egami, Narberth, Pa.; Philip J. Flanders, Moorestown, N.J.

[73] Assignee: University of Pennsylvania, Philadelphia, Pa.

[21] Appl. No.: 709,876

[22] Filed: July 29, 1976

Related U.S. Application Data

[63] Continuation of Ser. No. 507,861, Sept. 20, 1974, abandoned, which is a continuation-in-part of Ser. No. 495,786, Aug. 8, 1974, abandoned.

[51] Int. Cl.[2] ..... H01F 1/00

[52] U.S. Cl. ..... 148/120; 148/31.55; 148/131; 75/170

[58] Field of Search ..... 148/120, 131, 31.55, 148/108; 75/170, 134 F, 123 D; 333/30 R

[56] References Cited

U.S. PATENT DOCUMENTS

| | | | |
|---|---|---|---|
| 3,427,154 | 2/1969 | Mader et al. | 75/134 F |
| 3,472,708 | 10/1969 | Schindler | 148/108 |
| 3,660,175 | 5/1972 | Van Melis | 148/108 |
| 3,820,040 | 6/1974 | Berry et al. | 148/108 |
| 3,838,365 | 9/1974 | Dutoit | 333/30 R |
| 3,856,513 | 12/1974 | Chen et al. | 75/123 D |

*Primary Examiner*—Walter R. Satterfield
*Attorney, Agent, or Firm*—Paul & Paul

[57] ABSTRACT

A nickel based amorphous alloy in elongated ribbon form is subjected to a stress in the range of 20 to 40 kilograms per square millimeter, and is heated to temperatures below the melting point, preferably in the range of 200° C. Such heating under stress is maintained for a period of time, whereupon the material is cooled. There results a residual enhancement of the magnetic properties which occur by application of stress, but which are extinguished when the stress is removed.

8 Claims, 3 Drawing Figures

ENHANCING MAGNETIC PROPERTIES OF AMORPHOUS ALLOYS BY ANNEALING UNDER STRESS

CROSS REFERENCE TO PARENT

This is a continuation of application Ser. No. 507,861, filed Sept. 20, 1974 and now abandoned, which in turn is a continuation-in-part of Ser. No. 495,786, filed Aug, 8, 1974 and now abandoned.

BACKGROUND OF THE INVENTION

This invention relates to amorphous metallic alloys. More particularly, it relates to the enhancement of the magnetic properties of amorphous metallic alloys.

Amorphous metallic alloys, also sometimes referred to as "glassy metals", result when certain component materials are quenched from the molten state to the solid state at extremely high rates. For example, quenching at the rate of $10^5$ degrees per second has been found to result in an alloy which is substantially homogeneous and amorphous in form. That is, the rapid cooling prevents formation of a crystalline structure in the alloy material.

Until rather recently, the only known technology for the production of amorphous alloys utilized techniques such as vacuum evaporation, sputtering, electrodeposition, and the like. Also, the materials produced by those processes were not of convenient size or shape for extensive further development for some purposes, and any attempts to alter the shape destroyed their amorphous, homogeneous character.

More recently, however, production techniques have been developed whereby amorphous alloys may be synthesized in a convenient ribbon shape, and at a cost which appears to be quite economical. Consequently, considerable academic and industrial efforts are being undertaken to develop useful applications for the amorphous alloy materials.

It is a primary object of the present invention to provide useful applications for the class of amorphous magnetic metallic alloys.

Relevant properties of amorphous metallic alloys may be summarized briefly. Although homogeneous in composition, the amorphous alloys typically possess considerable strength, in contrast to conventional high strength alloys which consist of two or more phases. Rather than having standard stress-strain curve having a limited linear elastic range, followed by an elongated plastic strain region terminating at the ultimate strength, or breaking point, the amorphous alloys characteristically show a linear elastic region followed by a slightly nonlinear region ending at the breaking point. Amorphous alloys do not show the yield point behavior typical of crystalline alloys. The alloys do show some creep, the slow deformation which may occur over long periods of sustained loading. Magnetically, the alloys are "soft" materials, in that they possess relatively high permeability (i.e. the ratio of magnetic flux density produced in a medium to the magnetizing force producing it).

It is a more particular object of the present invention, in conformity with the foregoing properties of amorphous metallic alloys, to provide methods for enhancing the fundamental magnetic properties thereof, and further for utilizing the enhanced material in apparatus applications.

In a copending United States patent application of C. D. Graham, T. Egami, and P. J. Flanders, Ser. No. 709,857 filed contemporaneously herewith and assigned to the assignee hereof, there is disclosed a method of enhancing the magnetic properties of amorphous magnetic metallic alloys by application of stress. However, in accordance with the methods taught therein, whenever the stress is removed, the magnetic properties of the alloy revert to their previous values.

It is accordingly a further object of the present invention to instill enhanced properties in amorphous metallic alloys, in such a manner that at least a portion of the enhanced characteristics become residual in the material.

SUMMARY OF THE INVENTION

In accordance with the principles of the present invention, the beneficial results which accrue to the magnetic properties of amorphous alloys by application of stress, but which exist only during the application of stress, are rendered at least partially permanent by the use of annealing. That is, the materials are stressed to an extent which normally would produce substantial enhancement of magnetic properties, and the materials are heated in the stressed condition to a point below which melting occurs or crystalline structure begins to form. The temperature is sustained at that level for a predetermined amount of time, after which the heat is removed and the material is cooled. When the stress is removed, the residual magnetic properties of the material are substantially enhanced over those shown in the unstressed material before heating.

In an illustrative embodiment, a ribbon of nickel based amorphous alloy is stressed at 36 kilograms per square millimeter for 2 hours in air at 200° C. When the heating was completed and the load removed, the unstressed remanence, which was 35% of saturation prior to the processing, became 70% of saturation. Thereafter, when the material is stressed without heating, the magnetic effects are enhanced, but remanence values at high percentages of saturation (e.g. 94%) are achieved by stresses much smaller than those of corresponding unannealed material.

DETAILED DESCRIPTION

As set forth hereinbefore, practicable production methods and alloys of useful form only have been developed recently. Thus, only a limited variety of different compositions have been available for development and application of the principles of the present invention. However, in view of the properties and behavior stimulated and observed, the principles of the present invention are seen to be generally applicable to amorphous metallic alloys.

As set forth in the foregoing copending application of C. D. Graham et al, the magnetic characteristics which may be advantageously manipulated are the low field properties. Unloaded, the amorphous magnetic alloys possess a relatively low remanence and relatively high coercivity. As stress is linearly increased in the elastic range, the remanence at first increases linearly, but then falls off to a nearly exponential approach to the magnetic saturation level of the material. At a certain loading point, however, and therebeyond up to the ultimate strength of the material, a fixed percentage near but below the saturation limit is achieved, and is maintained up to the breaking point. The coercivity correspondingly decreases with stress, but levels at a loading somewhat less than the limiting point for remanence. Thus, for a given amorphous magnetic metallic alloy, there exists only a certain range, or "window" in which stress loading has the desired effect. Unless that window is utilized, variation of magnetic properties with load will not be achieved. For maximum remanence and minimum coercive force, any stress at or above the limiting point, but short of a stress which will provide deformation or fracture may be utilized. Whenever the stress is removed, the magnetic properties of the alloy revert to those of the original, unstressed material.

In accordance with the principles of the present invention, not only are the enhanced magnetic properties rendered substantially residual in the material, but furthermore, the useful window in which loading has the desired effect is translated downwardly to smaller stresses. As may be seen from comparison of the data set forth hereinafter, not only is the unstressed remanence and coercivity of the material substantially enhanced by annealing under stress, but furthermore the highest attainable remanence and the lowest attainable coercivity occurs for stresses in the annealed case substantially less than the stresses involved in the unannealed case.

Since the use of the stressed annealing process results in a material having residual enhanced magnetic properties, the resultant alloy may be utilized virtually anywhere good magnetic performance is desired. Moreover, for each such application, the magnetic response may be further enhanced by application of a controlled, limited amount of stress. Included among the suggested applications are transformer cores having a plurality of windings thereon; motor and generator laminations; magnetic delay lines wherein mechanical pulses are magnetically coupled into the alloy ribbon, are mechanically propagated thereon, and are magnetically sensed at the other end; stress and strain gauges; and computer memory cores.

It must be point out that the aforementioned range of stress is well above the yield point of conventional polycrystalline soft magnetic materials. Therefore, the application of the stress has beneficial effects exclusively upon amorphous materials. That is, if a stress of the aforementioned magnitude is applied to conventional soft magnetic materials, the materials will be severely plastically deformed causing serious adverse effects upon the low field magnetic properties, or they may even be fractured.

The principal merits of the use of amorphous materials under controlled stress are: (1) their low field properties, i.e., the remanence, the coercive field, and permeability, may excell those of the permalloys, (2) they are far less sensitive to mechanical damage than the permalloys, particularly than the supermalloys which are so sensitive to mechanical force that extreme care must be exercised in handling, (3) their electrical resistivity is significantly higher than the permalloys (e.g. 3 times), so that the high frequency performance is superior, (4) their production cost could be significantly lower than the conventional materials, inasmuch as the number of rolling operations is greatly reduced, and heat treatment in a hydrogen environment is necessary.

All of the compositions thusfar utilized have been possessed of positive magnetostriction. That is, when a magnetic field is imposed on the unstressed material, a slight physical expansion occurs. Generally, the stress applied in accordance with the principles of the present invention to enhance magnetic capabilities is a tensile stress for materials with positive magnetostriction, and a compressive stress for materials with negative magnetostriction.

Following are some examples of specific methods and tests which illustrate the principles of the present invention. Wherever appropriate, actual response curves and characteristics are submitted.

EXAMPLE

A ribbon shaped amorphous alloy sample 10cm long by 1.5mm wide by 35 micrometers thick, composed of nickel, 40 atomic percent; iron, 40 atomic percent; phosphorous, 14 atomic percent; and boron, 6 atomic percent; was placed under a tensile stress of 36 kilograms per square millimeter. The stressed amorphous alloy material was elevated to a temperature of 200° C in air, and held at that temperature for two hours. Thereupon, the heat was removed and the sample was cooled, and the stress was then removed.

Figure 1:
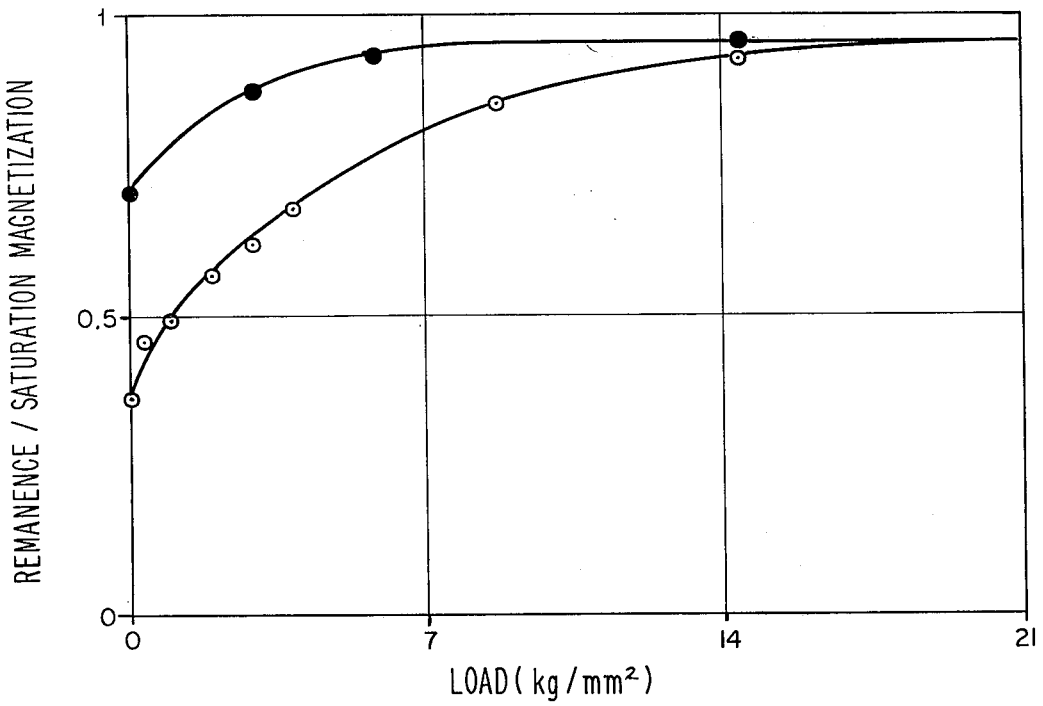
FIG. 1 shows a plot of remanence versus load for the example set forth hereinafter.

FIG. 1 depicts the effect of remanence on the sample annealed as set forth above, as compared with the remanence as a function of stess fo the same sample prior to the annealing process. Remanence is set forth on the oridnate as a fraction of saturation magnetization, and load is depicted on the abscissa in kilograms per square millimeter. Most noteworthy, the annealing process is seen to have the effect of conferring residual enhanced mangetization upon the amorphous alloy sample. Whereas in the unloaded state, the material prior to annealing had a remanence of 35%, the remanence after annealing has been improved to 70%, which is equivalent to the remanence of the material prior to annealing under approximately a four kilogram per square millimeter load. Thereupon, as the annealed alloy sample is loaded, the remanence further increases, reaching a value of 94% at approximately 6 kilograms per square millimeter loading. The remanence of the annealed product thereupon asymptotically approaches the same limiting value as it did prior to annealing.

Figure 2:
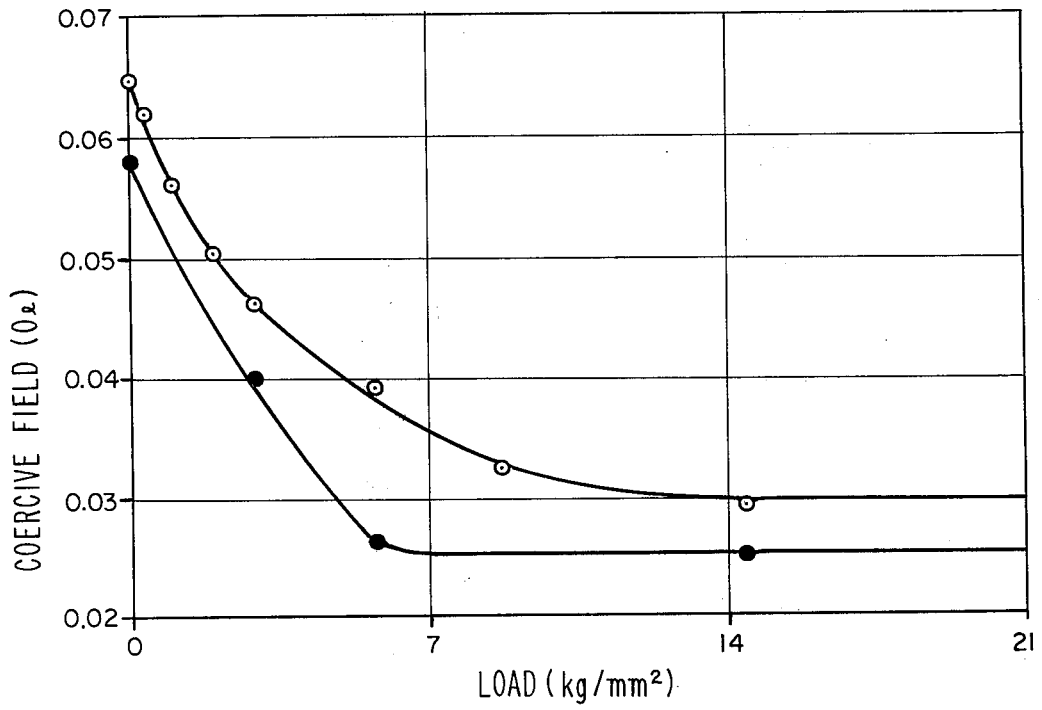
FIG. 2 shows a plot of coercive field versus load for the example set forth hereinafter.

In FIG. 2, the variation of coercive field with load of the annealed product is compared with its same characteristics prior to annealing. Coercive field is plotted on the ordinate in Oersteds and load is plotted on the abscissa in kilograms per square millimeter. Annealing may be seen to reduce the unloaded coercivity from 0.065 to approximately 0.058. Thereupon, subsequent loading further lowers the coercivity, down to a minimum of approximately 0.025, beyond which the coercivity remains fairly constant. From FIG. 2, it may be seen that not only is the attainable coercivity lower from the annealed samples than for the same samples prior to annealing, but furthermore the range in which the greatest change in coercive field occurs is considerably compressed. That is, for the annealed sample, the substantial reduction in coercive field occurs between no load and a load of 6 kilograms per square millimeter, whereas for the same sample prior to annealing, the entire reduction occurs over a much broader load range.

Figure 3:
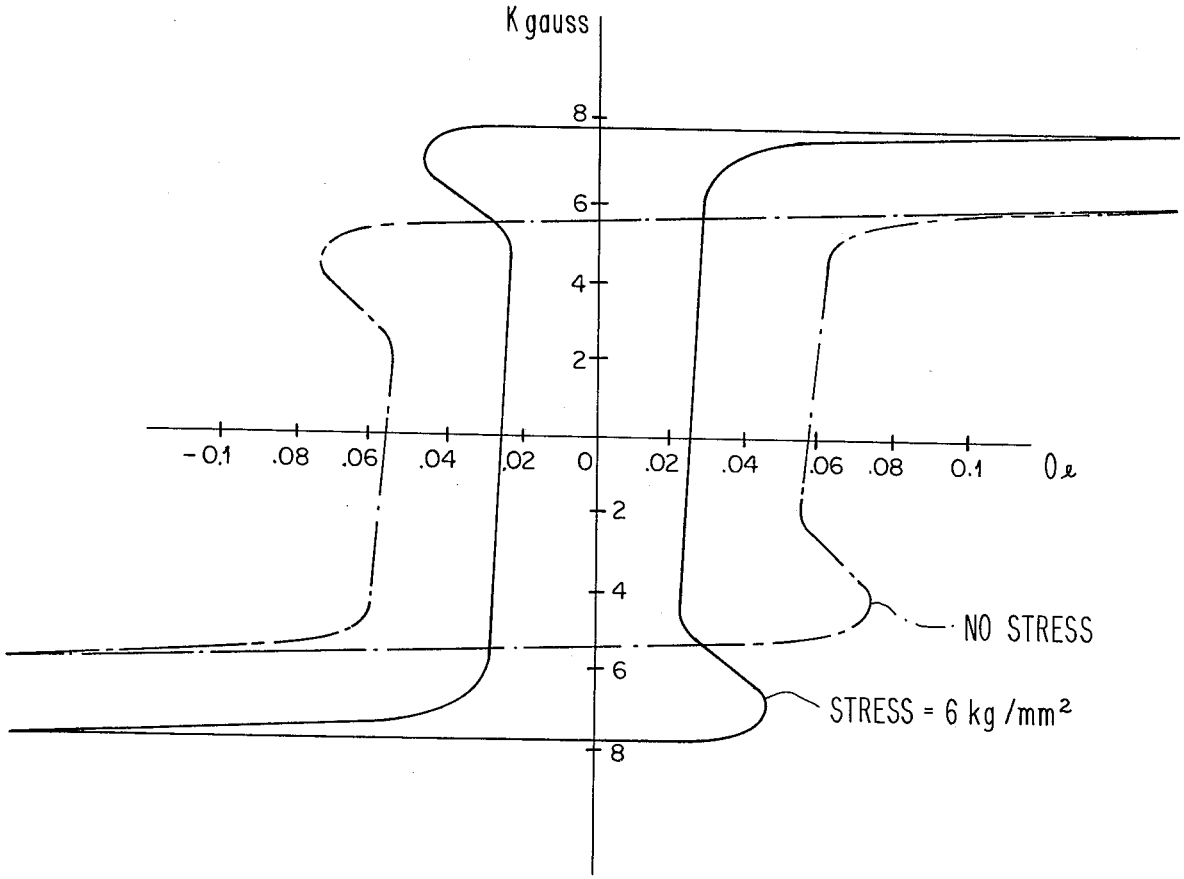
FIG. 3 shows exemplary hysteresis loops for the example set forth hereinafter.

FIG. 3 shows hysteresis loops of standard form for the unloaded annealed amorphous alloy sample. As may be seen from the loops, which are conventional in the art to represent magnetic performance, the loading substantially enhances magnetization (on the ordinate), decreases coercive field, (on the abscissa), and yet maintains a sharp field polarity switch. These loops may be compared to those of the foregoing application of C. D. Graham et al., which for purposes of disclosure is incorporated by reference herein.

We claim:

1. A method of providing a magnetically responsive metal comprising:

selecting a sample from the class of amorphous magnetic metallic alloys;

subjecting said sample to a controlled predetermined elastic stress;

heating said sample in a stressed condition to a predetermined temperature;

maintaining said sample in said heated state for a predetermined duration;

cooling said sample; and removing said stress;

whereby the remanence of said sample is substantially increased and the coercivity of said sample is substantially decreased.

2. A method as described in claim 1 wherein said temperature in said heating step is sufficiently below the melting point of said sample such that the amorphous structure of said sample is retained.

3. A method as described in claim 1 and further including, after said removing step, the steps of sequentially applying elastic stress to said sample, thereby further enhancing its magnetic properties.

4. A method of providing a metal having superior magnetic properties, including low coercivity and high permeability, comprising the steps of:

a. selecting a metal from the group consisting of substantially amorphous, noncrystalline magnetic metallic alloys having positive magnetostriction;

b. subjecting said alloy to a tensile stress less than the elastic limit of the alloy;

c. heating said sample in a stressed condition to a predetermined temperature below the crystallization point temperature of the sample;

d. maintaining said sample in a stressed, heated state for a predetermined duration, said heating and maintaining steps constituting an annealing process;

e. cooling said sample; and f. removing said stress after said cooling step;

g. said subjecting, heating, maintaining, cooling, and removing steps substantially increasing the remanence of said sample and substantially decreasing the coercivity of said sample while maintaining the amorphous, noncrystalline character of said sample.

5. A method as described in claim 4 wherein selecting step includes selecting a member of the class of nickel-iron based amorphous alloys.

6. A method as described in claim 5 wherein said predetermined temperature in in the range 200° to 250° C.

7. A method as described in claim 6 wherein said predetermined duration is at least 2 hours.

8. A method as described in claim 4 and further including, after said removing step, the steps of:

a. subjecting said sample to a tensile stress less than the elastic limit of said sample; and b. sustaining said tensile stress, thereby producing, during said sustaining step, an amorphous alloy having superior soft magnetic properties.

* * * * *